US007328545B2

(12) United States Patent
Koppen et al.

(10) Patent No.: US 7,328,545 B2
(45) Date of Patent: Feb. 12, 2008

(54) PACKAGING LINE AND METHOD FOR CONTINUOUSLY PACKAGING DISCRETE PRODUCTS

(75) Inventors: Menno Koppen, Hilversum (NL); Roberto Tuyn, Zaandam (NL)

(73) Assignee: Buhrs - Zaandam B.V., Zaandam (NL)

( * ) Notice: Subject to any disclaimer, the term of this patent is extended or adjusted under 35 U.S.C. 154(b) by 0 days.

(21) Appl. No.: 11/171,360

(22) Filed: Jul. 1, 2005

(65) Prior Publication Data

US 2006/0010839 A1 Jan. 19, 2006

(30) Foreign Application Priority Data

Jul. 2, 2004 (NL) ..... 1026563

(51) Int. Cl.
*B65B 9/06* (2006.01)

(52) U.S. Cl. ..... 53/374.6; 53/134.1; 53/550

(58) Field of Classification Search ..... 53/134.1, 53/374.6

See application file for complete search history.

(56) References Cited

U.S. PATENT DOCUMENTS

| | | | | | |
|---|---|---|---|---|---|
| 2,385,897 | A | * | 10/1945 | Waters | 53/134.1 |
| 3,237,371 | A | * | 3/1966 | Gerlach | 53/374.6 |
| 4,063,400 | A | * | 12/1977 | Millevoi | 53/548 |
| 4,553,377 | A | * | 11/1985 | Klinkel | 53/548 |
| 5,255,495 | A | * | 10/1993 | Kovacs | 53/504 |
| 5,462,160 | A | | 10/1995 | Youngs et al. | |
| 5,673,534 | A | * | 10/1997 | Fowler | 53/133.4 |
| 5,689,942 | A | * | 11/1997 | Suga | 53/550 |
| 5,875,614 | A | * | 3/1999 | Youngs et al. | 53/455 |
| 5,950,401 | A | | 9/1999 | Blohm et al. | |
| 6,868,650 | B2 | * | 3/2005 | Sanchez | 53/202 |
| 6,938,393 | B2 | * | 9/2005 | Timmerman et al. | 53/66 |

FOREIGN PATENT DOCUMENTS

| | | | |
|---|---|---|---|
| DE | 4418516 | A1 | 11/1995 |
| EP | 405595 | * | 6/1990 |
| EP | 0526944 | * | 2/1993 |
| EP | 0870678 | A1 | 10/1998 |
| EP | 1321367 | A1 | 6/2003 |

* cited by examiner

*Primary Examiner*—John Sipos
(74) *Attorney, Agent, or Firm*—Birch, Stewart, Kolasch & Birch, LLP

(57) ABSTRACT

A packaging line and method for continuously packaging discrete products such as, for instance, magazines, CDs, DVDs and combinations thereof in a continuous manner, comprising:

a product assembling path which is provided with a conveyor and feeders arranged therealong;

a packaging module provided with folding means for forming a packaging tube from a continuous packaging web, and a cross separating device for separating packages in cross direction;

a control which is designed for, inter alia, controlling the sealing means and the cross separating device such that per product to be packaged at least three cross seals are formed such that a packaged product is obtained which is characterized by a first and a second cross seal which are situated at a small distance from the end edges of the product and with a third cross seal which is situated at some distance from the second cross seal for forming a flap on the package.

21 Claims, 5 Drawing Sheets

PACKAGING LINE AND METHOD FOR CONTINUOUSLY PACKAGING DISCRETE PRODUCTS

The invention relates to a packaging line for continuously packaging discrete products such as, for example magazines, CDs, DVDs and combinations thereof, the packaging line being provided with:

a product assembling path which is provided with a first conveyor and a number of feeders arranged along the conveyor;

a packaging module provided with folding means for forming a packaging tube from a continuous packaging web, a second conveyor for advancing the packaging tube which is being formed in the packaging module, and a cross separating device for separating, in cross direction, packages filled with product from the packaging tube;

sealing means for providing cross seals in the packaging tube for forming individually packaged products;

a control for controlling the discharge of the products from the feeders, for controlling the transport speed of the conveyors and for controlling the speed of the cross separating device, the cross separating device comprising two separating elements such as, for instance, sealing beams or cutting knives, of which separating elements a first one is arranged above the packaging tube and a second one is arranged below the packaging tube, the separating elements traversing both a reciprocating vertical movement with a vertical stroke length and a reciprocating horizontal movement with a horizontal stroke length, while at least the horizontal stroke length is settable for processing both short and long products.

The invention further relates to a method for continuously packaging discrete products such as, for instance, magazines, CDs, DVDs and combinations thereof, wherein the method, utilizing a packaging line according to the invention, in a product assembling path which is provided with a first conveyor and a number of feeders arranged along the conveyors, assembles products while in a packaging module by means of folding means from a continuous packaging web a packaging tube is formed, which packaging tube is advanced in the packaging module by a second conveyor, while, with sealing means, cross seals are provided in the packaging tube for forming individually packaged products, while with a cross separating device separate packages filled with product are separated from the packaging tube, a control controlling the discharge of the products from the feeders as well as the transport speed of the conveyors and the rate of the cross separating device, the cross separating device comprising two separating elements such as for instance sealing beams or cutting knives, of which separating elements a first one is arranged above the packaging tube and a second one is arranged under the packaging tube, the separating elements traversing both a reciprocating vertical movement with a vertical stroke length and a reciprocating horizontal movement with a horizontal stroke length.

Such a packaging line and method are known from EP-A-1 321 367.

The object of the present invention is to provide a packaging line and a method by means of which packages with products contained therein can be manufactured which are characterized by a first and a second cross seal which are situated at a small distance from the end edges of the product and a third cross seal which is situated at some distance from the second cross seal for forming a flap on the package.

To that end, the packaging line of the type mentioned in the opening paragraph is characterized in that the control is designed for driving the sealing means and the cross separating device such that per product to be packaged at least three cross seals are formed such that a product to be packaged is obtained which is characterized by a first and a second cross seal which are situated at a small distance from the end edges of the product and a third cross seal which is situated at some distance of the second cross seal for forming a flap on the package.

To that end, the method of the type mentioned in the opening paragraph is characterized in that the control drives the sealing elements and the cross separating device for forming three cross seals per product to be packaged such that a packaged product is obtained which is characterized by a first and second cross seal which are situated at a small distance from the end edges of the product and a third cross seal which is situated at some distance from the second cross seal for forming a flap on the package.

Owing to the control being arranged for driving the sealing means and the cross separating device in a manner so as to form three cross seals per product to be packaged, the above obtained package with flap is realized, while the product is yet accurately locked between the first and the second cross seal. Consequently, the position of the product in the package is accurately defined and also an additional printable surface is provided which can be used, for instance, for advertisement. Moreover, the flap imparts to the package the possibility of suspending the magazine from a hook or the like. Evidently, the flap must then be provided with an opening, which opening can be provided in the flap by means of a die-cutting operation, for instance during the formation of a cross seal or after the formation of a stack of packages.

According to a further elaboration of the invention, for the purpose of processing a packaging material web from plastic, the sealing means can comprise the separating elements of the cross separating device which are designed as sealing beams, the horizontal stroke length being settable for forming flaps of different dimensions.

Compared with the packaging line described in the above-mentioned European publication, hardly anything needs to be changed in the construction since all mechanical components for providing the apparatus according to the invention are already present with the exception of a suitable control. As a result of this modification in the control, however, the operation of the packaging line will change in the sense that per package three cross seals are formed. Accordingly, by adaptation of the control, the apparatus known per se can be simply rendered suitable for manufacturing two kinds of packages, viz.: the packages already known, manufactured heretofore with the packaging line, with two cross seals without flap, and the above-described package with three cross seals and provided with the flap, which package could not heretofore be manufactured on a packaging line of the type described in the opening paragraph.

According to an alternative further elaboration of the invention, for the purpose of processing a packaging material web from paper the sealing means can comprise a cross gluing applicator which is disposed upstream of the folding means and which is arranged for applying glue patterns extending perpendicularly to the longitudinal direction of the packaging web, while the sealing means further comprise press-on beams arranged in the cross separating device, a first press-on beam being disposed above the packaging tube, and a second press-on beam being disposed under the packaging tube, while the separating elements comprise a cutting knife assembly, press-on beams and the cutting knife assembly traversing both a reciprocating vertical movement having a vertical stroke length, and a reciprocating horizontal movement having a horizontal stroke length, while at least the horizontal stroke length is settable to enable processing of both short and long products and for forming flaps of different dimensions.

It holds true also for this alternative variant that the constructional elements thereof were already present per se, with the exception of the control. For the cross gluing applicator upstream of the folding means is already described in EP-A-0 526 944. A packaging line with such a cross gluing applicator and with press-on beams in combination with cutting knives traversing the movement patterns described, has been marketed by applicant for a great number of years now. The control added thereto by the invention affords the possibility of manufacturing packages from paper in which a product is included and where the package is provided with three cross seals, of which the first and second lock the product and of which the second and the third form the boundary of the flap. Accordingly, per package to be formed, three cross gluing patterns are applied to the paper web. Moreover, per package the press-on beams will perform a press-on operation three times and a cutting operation twice.

According to a further elaboration of the invention, the packaging line may be characterized by a control which is designed for processing information about the length of each product to be packaged and/or information about the length of the flap and for in-process setting per product for the horizontal stroke length of the sealing beams such that packages of different lengths for products of different lengths and packages with flaps of different lengths can be manufactured in random order.

Owing to the control being arranged for processing information about the length of each product to be packaged and/or information about the length of the flap and for in-process setting per product of the horizontal stroke length of the sealing beams, packages of different lengths for products of different lengths can be manufactured in random order. Through this real-time conversion, an optimum flexibility of the packaging line and the method is obtained. In the packaging line for processing paper, the control will not only have to be capable of in-process setting per product of the stroke length of the press-on beams and the cutting knives but also of operating the cross gluing applicator such that the cross gluing patterns are applied at the desired positions and that the press-on beams and the cutting knives perform their work at the correct positions in the packaging web, in order that packages of different lengths for products of different lengths and with flaps of different lengths can be manufactured in random order.

With such a packaging line, a saving on packaging material can be realized. Further, every product is accommodated in a package matching it in length, which is desirable because a properly fitting package protects the product better and moreover because it is beneficial to the appearance of the packaged product.

Preferably, the upper sealing beam or press-on beam and cutting knife are drivable by a first controllable drive for traversing a vertical movement and by a second controllable drive for traversing a horizontal movement. A third controllable drive can be used for traversing a vertical movement of the lower sealing beam or press-on beam and cutting knife. The horizontal movement of these lower sealing beams or press-on beams and cutting knives is preferably also effected by the second controllable drive. A fourth controllable drive can be used for variably driving a conveyor serving as pull device, for pulling loose a downstream product of the packaging tube.

Owing to the drives being controllable, the path along which the movements proceed and the rate at which these movements proceed can be simply varied. Thus, the movement of the first sealing beam or press-on beam with cutting knife in the direction perpendicular to the transport surface can be accurately controlled. This also holds true of the movement of the second sealing beam or press-on beam with cutting knife in the direction perpendicular to the transport surface. Further, the movement of the sealing beam or press-on beam with cutting knife in the direction of the transport surface can be accurately controlled. With the second controllable drive a perfect synchronization of the sealing beams or press-on beams with cutting knives with the transport rate of the conveyor upstream of the separating elements can be achieved, so that during the separation of the packaging tube, that is, when it is being cut through in case of paper and during sealing thereof in the case of a plastic film web, no forces are exerted on the packaging tube in the transport direction. If desired, during separation, the packaging tube can be pulled a little or, conversely, be paid out a little. The independently controllable drives also afford the possibility of providing more than two cross seals per package, so that packages with one or two flaps can be manufactured. Accordingly, per product two or three different horizontal stroke lengths can be set, and this setting can be modified in-process per product. Owing to the sealing or press-on time being independent of the speed of the packaging line, forming the seal can be completed even after the rest of the packaging line has stopped. Moreover, making a larger stroke is possible and the sealing or press-on time is independent of the speed of the packaging line. Especially with sealing, this is of great importance because the sealing time can thus be accurately set. Thus, for instance, a thick film can be sealed longer and the seal separating the product from the flap can be sealed for a shorter time than the seals separating the mutual packages. The independent control of the separating elements moreover affords the possibility of packaging very long products; thus, even surf boards could be packaged in film. Moreover, the controls may be provided with a memory in which the settings associated with a particular job, for instance the packaging of a particular weekly, are stored. When such a job then comes up again, the packaging machine can directly retrieve values associated with that job and the packaging line is set directly, so that packaging can be started directly. As in modern controllable drives, such as for instance controllable servo motors, the control proceeds digitally, the settings will not drift. Also of interest is that such a separation module can be tested stand alone without forming part of the packaging line. Thus, for instance, the sealing time for a particular film can be tested outside the packaging line.

By means of the fourth controllable drive, the speed of the packaged product downstream of the sealing beams or press-on beams with cutting knives relative to the packaging tube situated upstream of the separating elements can be varied, for instance for pulling the downstream separated product loose from the packaging tube, which is required when sealing, at least, can promote the separating process.

It may be clear from the foregoing that the separating elements can comprise sealing beams to be heated for separating a packaging tube of plastic film. However, it is also possible that the separating elements comprise knives for separating a packaging tube of paper.

As the first, second and third drives realize a reciprocating movement whose stroke is settable and whose starting and end points are settable, in order that the stroke and the path along which the reciprocating movement of the separating elements proceed is settable, for instance the position of the point of contact at which the separating elements touch relative to the transport surface can be varied. For instance, the point of contact can be positioned halfway the thickness of the products to be packaged above the transport surface. What is thus effected is that between the products, a minimum amount of material is required for closing the package with the aid of the separating elements. In particular with thick products this can save a considerable amount of packaging material. Moreover, it can thus be effected that with thin products only a small stroke is made, which influences the speed of the device in a positive manner.

Further elaborations are described in the subclaims and will be further clarified on the basis of an exemplary embodiment, with reference to the drawing. In the drawing:

Figure 1:
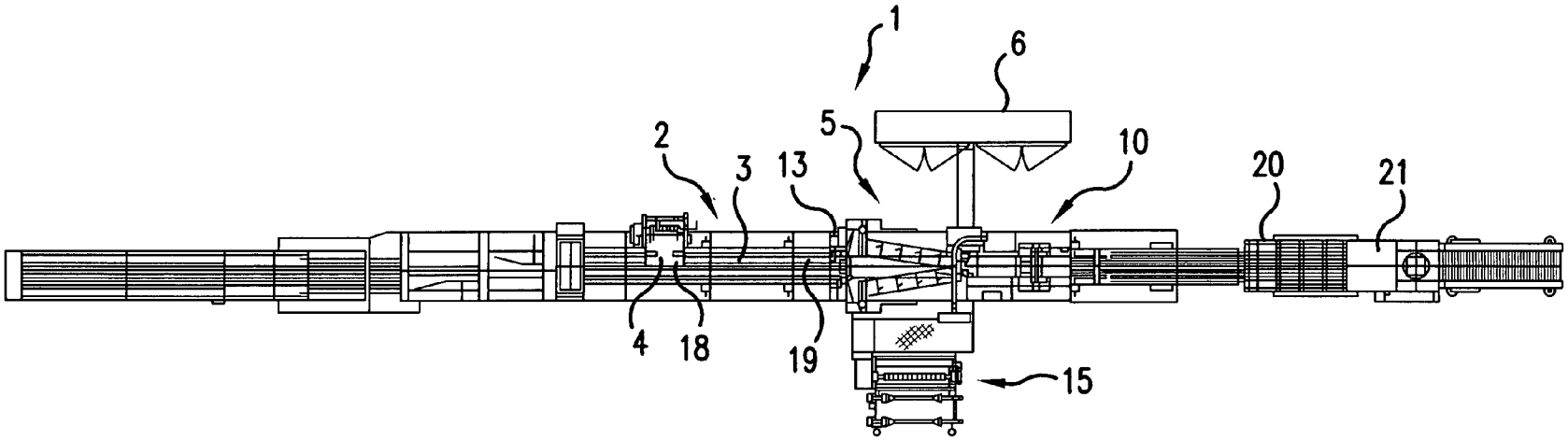
FIG. 1 shows a top plan view of an exemplary embodiment of a packaging line.
Figure 2:
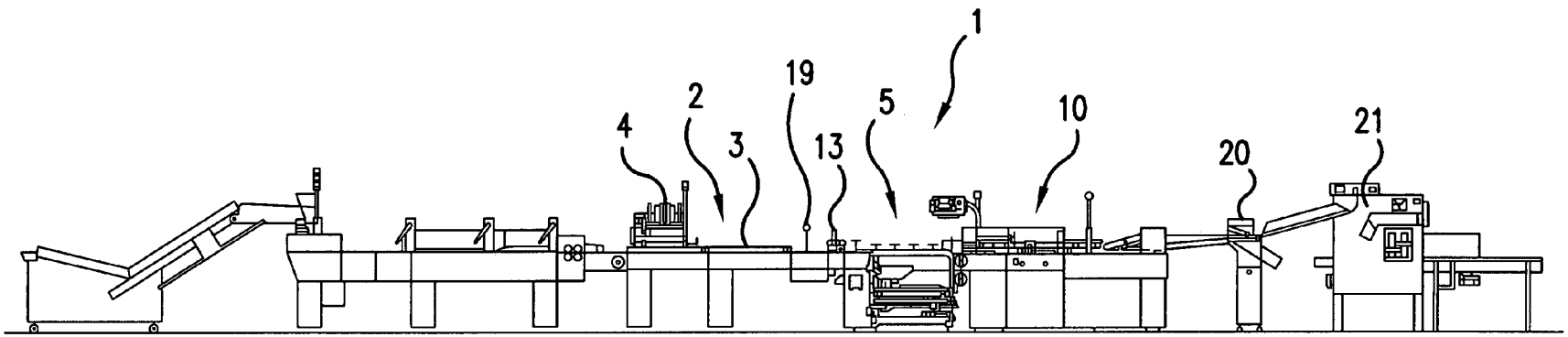
FIG. 2 shows a side view of the packaging line represented in FIG. 1.
Figure 3:
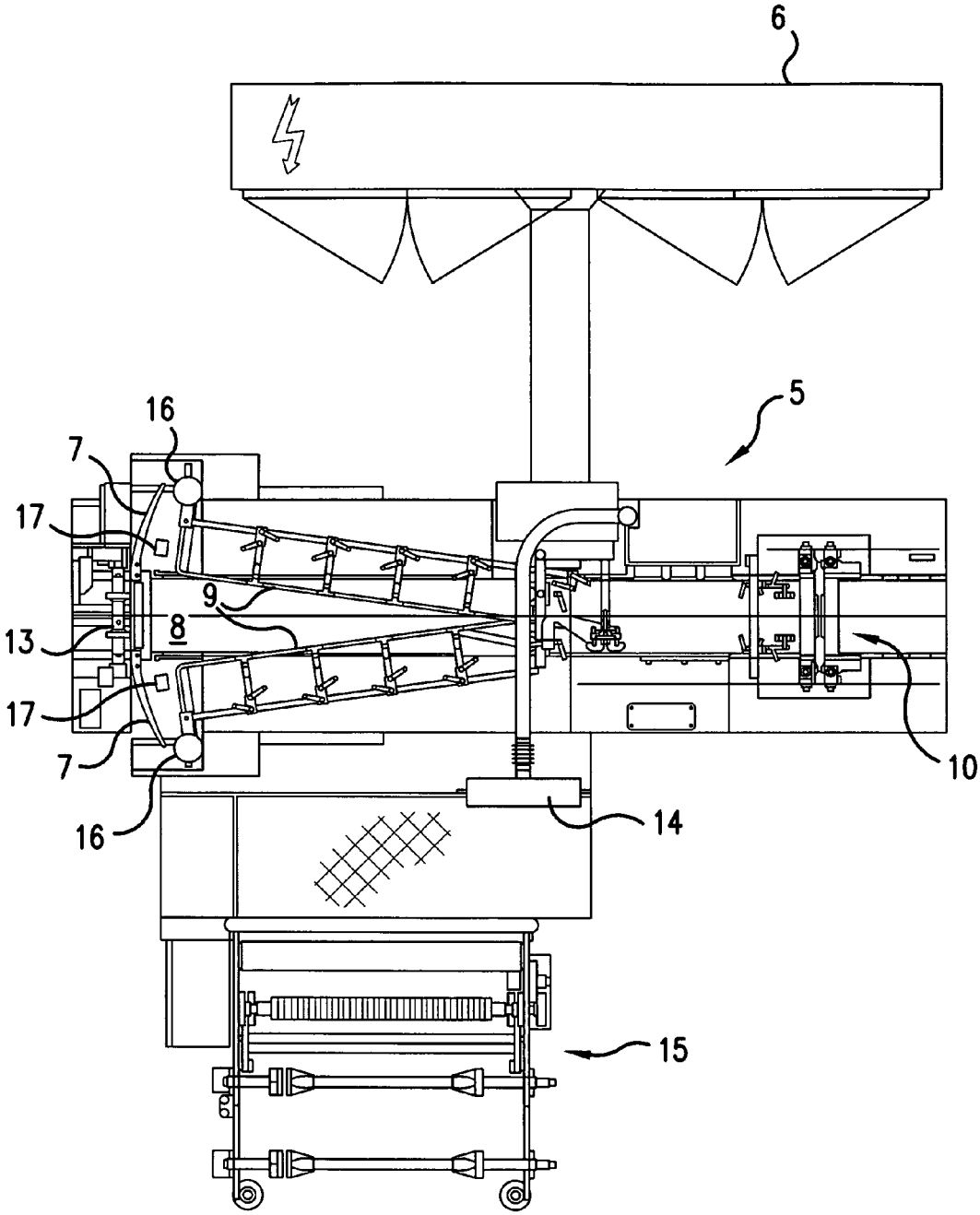
FIG. 3 shows a top plan view of a packaging module used in FIGS. 1 and 2.
Figure 4:
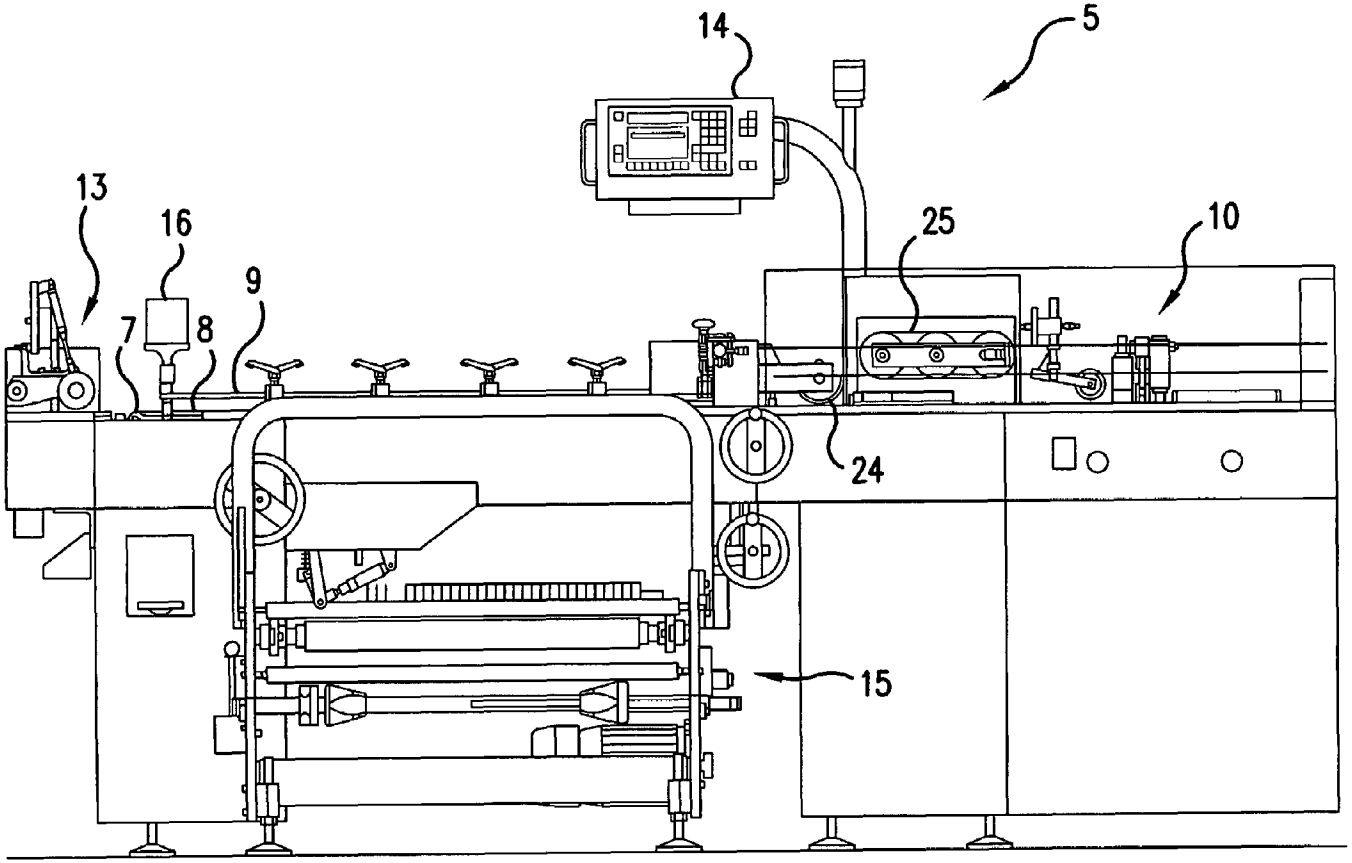
FIG. 4 shows a side view of the packaging module represented in FIG. 3.

FIGS. 1 and 2 show a packaging line 1 for packaging magazines, documents, CDs, DVDs or combinations thereof. The packaging line 1 has a product assembling path 2 provided with a first conveyor 3 and a number of feeders 4 arranged along the conveyor. In this product assembling path 2, products are assembled which are built up, for example, from a number of documents. These assembled products then need to be packaged. This packaging takes place in a packaging module 5. In this packaging module 5, with the aid of folding means 7, 9, a packaging tube is formed from a continuous packaging web. The packaging tube is advanced by a second conveyor 8 in the packaging module 5 in a continuous manner but, optionally, at variable speed. By means of a cross separating device 10, separate packages filled with product are separated from the packaging tube. A control 6 controls the discharge of the products from the feeders 4 as well as the transport speed of the conveyors 3, 8 and the rate of the cross separating device 10. As clearly represented in FIG. 5, the cross separating device 10 is provided with two separating elements 101, 102, such as, for instance, sealing beams or press-on beams with cutting knives. With the press-on beams with cutting knives, a paper web can be processed while the press-on beams press the layers of paper onto each other at the location of the previously applied glue patterns, the cutting knives cutting the packaging tube substantially simultaneously in cross direction for forming a loose package with a product included therein. The cross-gluing patterns are applied to the paper web upstream of the folding means 7, 9 in a manner known per se with a cross gluing applicator (not represented). A first separating element 101 is arranged above the packaging tube and a second separating element 102 is arranged under the packaging tube. The separating elements 101, 102 traverse both a reciprocating vertical movement with a vertical stroke length and a reciprocating horizontal movement with a horizontal stroke length. The Figures further show an unwinder 15 on which a roll of packaging material can be placed and from which it can be unwound. The packaging material web can be both paper and sealable plastic film. In the first case, the separating elements 101, 102 are press-on beams with cutting knives, in the latter case the separating elements 101, 102 are sealing beams. FIGS. 3 and 4 further show a product positioning station 13 with the aid of which the products assembled in the product assembling path 2 are placed on the packaging web, an operating console 14 and a longitudinal sealing element 24 for interconnecting the overlapping longitudinal edges of the packaging tube already formed there. Further, in FIG. 4, the pulling belt 25 is clearly visible with the aid of which the packaging tube with the products present therein is pulled forward.

According to the invention, the control 6 is designed for driving the sealing means 101, 102 and the cross separating device such that per product to be packaged, three cross seals are formed such that a packaged product is obtained which is characterized by a first and a second cross seal which are situated at a small distance from the end edges of the product and a third cross seal which is situated at some distance from the second cross seal for forming a flap on the package.

Figure 6:
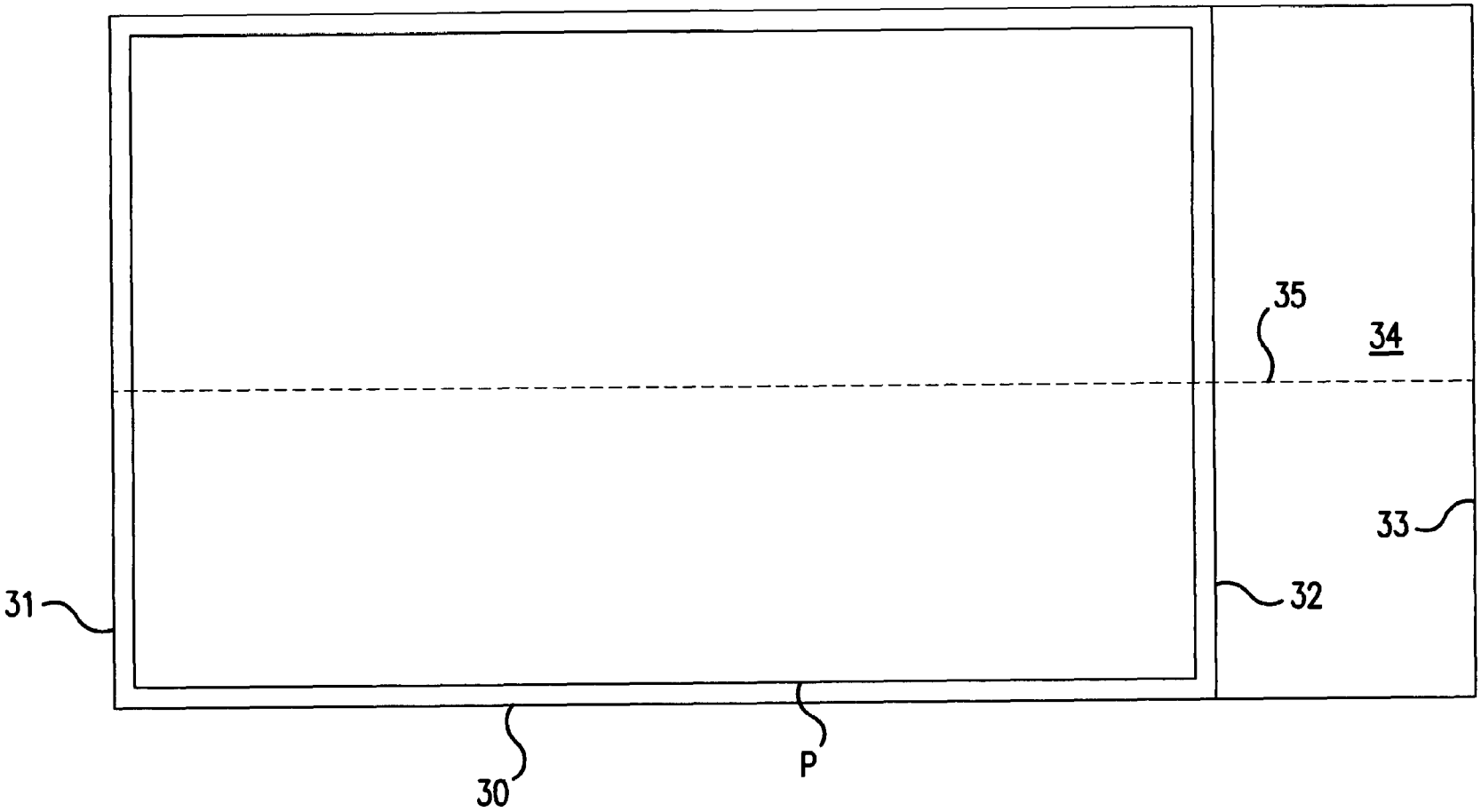
FIG. 6 shows an exemplary embodiment of a product to be obtained with the packaging line and the method according to the invention.

One exemplary embodiment of the product to be formed is represented in FIG. 6. The product P is included in a package 30. Clearly visible are two cross seals 31, 32 which are situated at a small distance from the end edges of the product P. Further, the third cross seal 33 is visible, which is situated at some distance from the second cross seal 32 for forming the flap 34 on the package 30.

Therefore, the control 6 is designed such that per product to be packaged, the separating elements 101,102 make two different horizontal strokes; one long stroke for bridging the length defined by product P and a short stroke for bridging the length defined by the flap 34 to be formed. The invention also comprises a control 6 with the aid of which a package 30 with two flaps 34, one on either side of the product, can be formed. To that end, per product P to be packaged, four cross seals will have to be formed.

Preferably, the control 6 is designed for processing information about the length of each product to be packaged and about the desired length of the flap to be formed, and the horizontal stroke lengths are set in-process per product such that packages of different lengths for products of different lengths and with flaps of different lengths can be manufactured in random order.

In the present exemplary embodiment, the control 6 also processes information about the thickness of each product to be packaged and the vertical stroke length is set in-process per product such that products of different thickness can be processed in random order.

In the present exemplary embodiment, the control 6 further processes in formation about the width and/or the thickness of each product to be packaged. The folding means 7, 9 are provided with actuators 17, 16, respectively, with the aid of which the position of the folding means 7, 9 can be automatically set in-process by operation of these actuators 16, 17 by the control 6. Operation of the actuators 16, 17 depends on the information about the width and/or thickness of each product such that a packaging tube of suitable dimensions is formed from the continuous packaging web.

In the present exemplary embodiment, the folding means 7, 9 comprise folding bars 9, whose position can be set in-process with the aid of actuators 16. The folding means 7, 9 further comprise a packaging web guiding element 7 over which a packaging web, fed from a bottom side, is guided in the horizontal plane of the second conveyor 8, and over which the forming of the packaging tube from the packaging web is initiated. The width and/or form of the packaging web guiding element 7 is set by two actuators 17, which actuators are operated in-process by the control 6, depending on the data available in the control 6 about width and/or thickness of a product to be packaged.

The control 6 can obtain the data about the dimensions of each product to be packaged from a database, in which database the dimension data of each product that is assembled in the product assembling path have been stored.

In the present exemplary embodiment, the packaging line 1 is provided with sensors 18, 19, which sensors 18, 19 pick up information about the dimensions of products which are assembled in the product assembling path 2. The control 6 derives the data about the dimensions of each product to be packaged from signals which are given off by the sensors 18, 19 mentioned.

In the exemplary embodiment, each feeder 4 is provided with at least one sensor 18 which gives off the dimension information about the product present in the feeder 4 to the control 6. Further, at the first conveyor 3, a sensor 19 is arranged which obtains dimension information from products transported by the first conveyor 3.

Downstream of the cross separating device 10, an ejecting station 20 is disposed. On the basis of the dimension data of a respective product, the control 6 sets the ejecting function of the ejecting station 20. In the present exemplary embodiment, the ejecting station 20 is provided with a switch which can assume a feed-through position and an ejecting position. The control 6 is designed for regulating the duration in which the switch is held in the ejecting position depending on the length of the product known in the control 6. This duration can be varied in-process depending on the length of the product which is to be ejected.

Further downstream of the cross separating device 10, a stacker 21 is arranged. The stacker 21 is provided with actuators for automatically setting the stacker 21 depending on the dimensions of the products to be stacked. On the basis of the dimension data of a respective product, the control 6 controls the actuators for setting the stacker 21 in-process.

Figure 5:
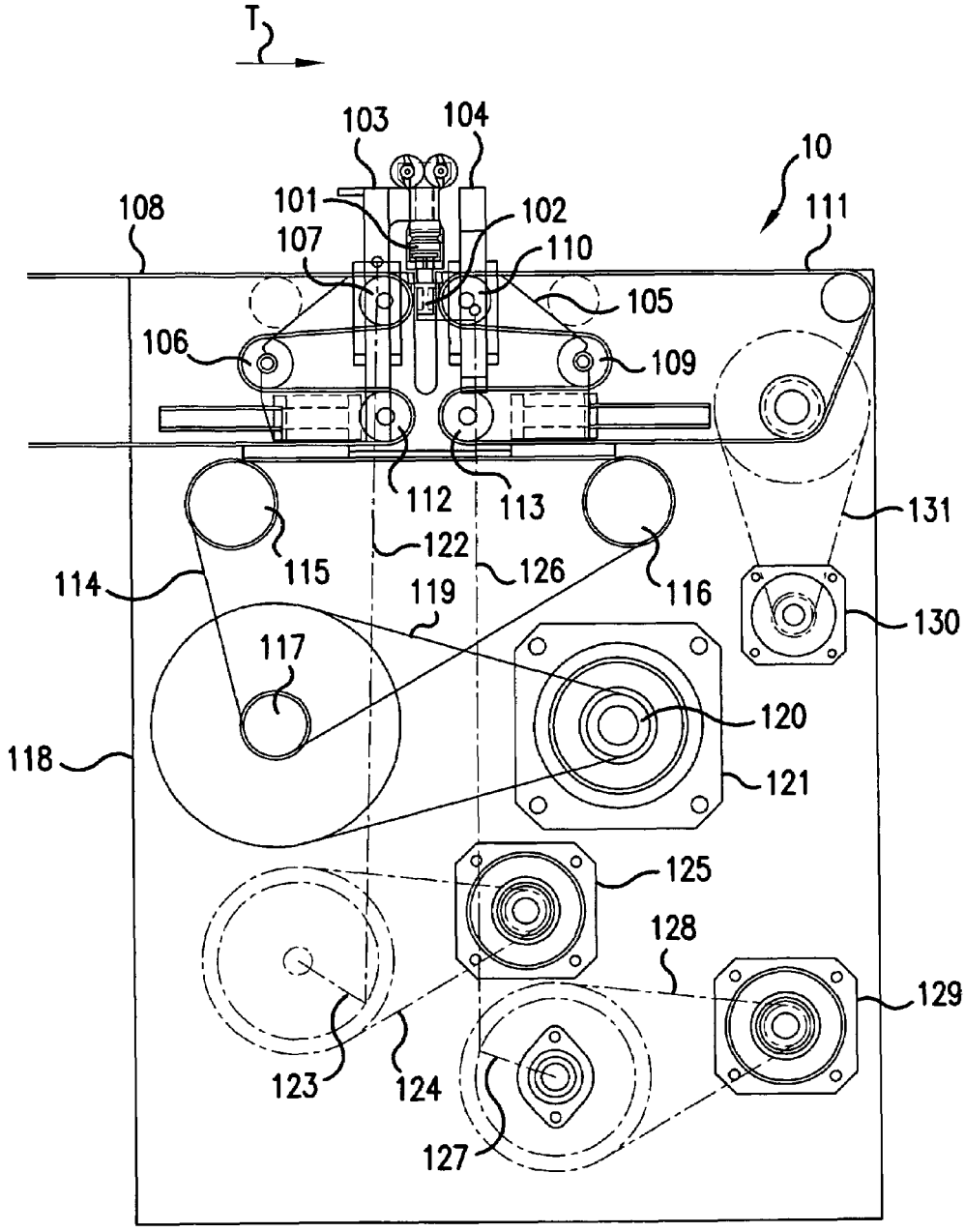
FIG. 5 shows an exploded view of the cross separating station which can be used in the exemplary embodiment shown.

It is noted that in the exemplary embodiment of the cross separating element 10 represented in FIG. 5, the respective module is provided with an upper sealing beam 101 and a lower sealing beam 102. The upper sealing beam 101 is arranged for upward and downward movement in a first guide 103. The lower sealing beam 102 is also arranged for upward and downward movement in a second guide 104. These guides 103 and 104 are connected, in their turn, to a frame plate 105 which can is arranged for reciprocating movement in the transport direction indicated with the arrow T. Moreover, this frame plate 105 bears two return wheels 106, 107 of a conveyor 108 arranged upstream of the sealing beams, and two return wheels 109, 110 of a conveyor 111 arranged downstream of the sealing beams 101, 102. The upstream conveyor 108 is further provided with a return wheel 112 arranged for rotation around a fixed axis. The downstream conveyor 111 too has such a return wheel 113 arranged for rotation around a fixed axis. As a result of this configuration of return wheels, the frame plate 105 can be moved to and fro without this affecting the tension on the conveyor belt 108 or the conveyor belt 111. The frame plate 105 is connected to a toothed belt 114 which is guided over three return wheels 115, 116, 117. The return wheel 117 is connected to a drive wheel 118 over which a toothed belt 119 is guided which is connected to a drive shaft 120 of a controllable servomotor 121. Via a connecting rod 122, the upper sealing beam 101 is connected to a crank rod 123 or a similar excenter. The crank rod 123 traverses a reciprocating movement which, via a toothed belt or drive chain 124, is imposed on the crank rod by a driving motor 125 in the form of a controllable servomotor 125. Also for the lower sealing beam 102, a connecting rod 126 is present which is driven, via a crank rod or like excenter 127 and a toothed belt 128 by a servomotor 129 which is controllable. The downstream conveyor 111 is driven via a controllable servomotor 130 and a toothed belt 131 connected thereto. As all drives can be controlled independently of each other, the horizontal paths of the sealing beams can be accurately set and the duration for which the sealing beams are pressed onto each other as well as the position at which the sealing beams will touch each other can be accurately set. Thus, the advantages which are described in the introduction to the specification are achieved and packages for products of different lengths and with flaps of different lengths can be manufactured in random order. As modern servomotors are driven with digital control techniques, the values set for a particular job can be stored in the memory of the control, so that these values, when the respective job occurs again, can be directly retrieved, so that the desired setting is directly available.

It is, however, also possible that the horizontal and vertical stroke is energized by one single motor and that the size of the stroke can be influenced by adjustment of a coupling mechanism connecting the horizontal movement to the vertical movement. Evidently, for the automatic in-process setting of the coupling mechanism, an actuator to be energized by the control 6 is to be present.

It will be clear that the invention is not limited to the described exemplary embodiment but that various modifications are possible within the framework of the invention as defined by the claims.

For instance, the control for realizing the two different horizontal stroke lengths can also be realized in a mechanical manner, utilizing, for instance, a link system, cam system or similar mechanical provision.

It is noted that with the present method and apparatus it is also possible to accommodate an additional product in the flap or flaps, such as for instance a gadget or a graphic product. It is even possible, with mutually connected flaps, wherein in each flap a product is accommodated, to package a series of products which are mutually connected by the package.

The invention claimed is:

1. A packaging line for continuously packaging discrete products, comprising:

a product assembling path, said product assembling path including a first conveyor and a number of feeders arranged along the conveyor;

a packaging module, said packaging module including:

a folding device that forms a packaging tube from a continuous packaging web;

a second conveyor that continuously advances the packaging tube being formed in the folding device; and a cross separating device that separates, in a cross direction, packages filled with products from the packaging tube, the cross separating device including two separating elements, a first separating element being arranged above the packaging tube and a second separating element being arranged below the packaging tube, the two separating elements traversing both a reciprocating vertical movement with a vertical stroke length and a reciprocating horizontal movement with a horizontal stroke length, and at least the horizontal stroke length is settable for processing both short and long products;

a single sealing device that provides cross seals in the packaging tube to form individually packaged products; and a control that controls the discharge of the products from the feeders, a transport speed of the conveyors and a speed of the cross separating device, wherein the control is arranged to drive the sealing device and the cross separating device such that at least three cross seals are formed per product to be packaged during movement of the web, a first and a second cross seal being situated at a small distance from end edges of the product and a third cross seal being situated at some distance from the second cross seal to form a flap on the package.

2. The packaging line according to claim 1, wherein the sealing device, for the purpose of processing a package material web from plastic, comprises the separating elements of the cross separating device designed as sealing beams, while the horizontal stroke length is also settable for forming flaps of different dimensions.

3. The packaging line according to claim 1, wherein the sealing device, for the purpose of processing a package material web from paper, comprises a cross gluing applicator disposed upstream of the folding device, said cross gluing applicator being arranged to apply glue patterns extending perpendicularly to a longitudinal direction of the packaging web, the sealing device further comprising press-on beams arranged in the cross separating device, a first press-on beam being arranged above the packaging tube and a second press-on beam being arranged under the packaging tube, the separating elements comprising a cutting knife assembly, the press-on beams and the cutting knife assembly traversing both a reciprocating vertical movement with a vertical stroke length and a reciprocating horizontal movement with a horizontal stroke length, at least the horizontal stroke length being settable to enable processing of both short and long products and for forming flaps of different dimensions.

4. The packaging line according to claim 2, wherein said control is arranged to process information about the length of each product to be packaged or information about the length of the flap, said control being arrange for in-process setting per product of the horizontal stroke length of the sealing beams such that packages of different lengths for products of different lengths and packages with flaps of different lengths can be manufactured in random order.

5. The packaging line according to claim 3, wherein said control is arranged to process information about the length of each product to be packaged or information about the length of the flap, said control being arranged for in-process setting per product of the horizontal stroke length of the press-on beams and the cutting knives as well as in-process operation of the cross gluing applicator such that the cross gluing patterns are applied at the desired positions and such that the press-on beams and the cutting knives perform their work at the correct positions in the packaging web, in order that packages of different lengths for products of different lengths and with flaps of different lengths can be manufactured in random order.

6. The packaging line according to claim 4 or 5, wherein a first sealing beam or a first press-on beam and cutting knife, respectively, disposed above the packaging tube, is arranged for movement in a direction perpendicular to the transport surface, a first controllable drive determining the movement of the first sealing beam or first press-on beam and cutting knife, respectively.

7. The packaging line according to claim 6, wherein a second controllable drive determines the movement of the sealing beams or press-on beams and cutting knives, respectively, along the transport direction.

8. The packaging line according to claim 6, wherein a second sealing beam or press-on beam and cutting knife, respectively, disposed under the packaging web is arranged for movement in a direction perpendicular to the transport surface, a third controllable drive determining the movement of the second sealing beam or press-on beam and cutting knife, respectively, in the direction perpendicular to the transport surface.

9. The packaging line according to claim 1, wherein downstream of the sealing beams, a pull device in the form of at least one conveyor is disposed, the conveyor serving as a pull device being provided with a controllable drive for driving the respective conveyor at variable speed.

10. The packaging line according to claim 6, wherein the first drive realizes a reciprocating movement whose stroke is settable and whose starting and end points of the reciprocating movement are settable in order that the stroke and the path along which the reciprocating movement of the first sealing beam or press-on beam and cutting knife proceed are settable.

11. The packaging line according to claim 8, wherein the third drive realizes a reciprocating movement whose the stroke is settable and whose starting and end points are settable such that the stroke and the path along which the reciprocating movement of the second sealing beam or press-on beam and cutting knife proceed are settable.

12. The packaging line according to claim 7, wherein the second drive realizes a reciprocating movement which has two different stroke lengths, both stroke lengths being settable and where the starting and end points of the reciprocating movements are settable such that the strokes and the path along which the reciprocating movement along the transport direction of the separating elements proceed are settable, while per product at least two stroke lengths are set such that per product at least three cross seals are formed.

13. The packaging line according to claim 6, wherein the first and the second sealing beam or press-on beam and the cutting knives are bearing mounted in a first and second guide, respectively, which guides are connected to a frame plate which, via a third guide running parallel to the transport surface, is arranged for movement along the transport direction for traversing said synchronous reciprocating movement, while the second drive is connected to said frame plate.

14. The packaging line according to claim 13, wherein the first drive is connected via a chain or toothed belt to a first crank rod, which first crank rod is connected via a first drive shaft to the first sealing beam or press-on beam and cutting knife.

15. The packaging line according to claim 13, wherein the third drive is connected via a chain or toothed belt to a second crank rod, which second crank rod is connected, via a second drive shaft to the second sealing beam or press on beam.

16. The packaging line according to claim 9, wherein the fourth drive is connected, via a toothed belt or chain, to the conveyor disposed downstream of the sealing beam or press-on beam.

17. The packaging line according to claim 13, wherein the conveyor disposed upstream of the sealing beams or press-on beams is provided, on an end proximal to the sealing beams or press-on beams, with three return wheels, one of which is disposed for rotation about a fixed axis, while the other two are each disposed for rotation about an axis belonging to the return wheel which two axes are connected to said frame plate.

18. The packaging line according to claim 13, wherein the conveyor disposed downstream of the sealing beams or press-on beams is provided, on an end proximal to the sealing beams or press-on beams, with three return wheels, one of which being disposed for rotation about a fixed axis, while the other two are each disposed for rotation about an axis belonging to the respective return wheel, which two axes are connected to said frame plate.

19. The packaging line according to claim 6, wherein the first controllable drive is a servo motor that is connected to a control belonging to the servo motor.

20. The packaging line according to claim 1, wherein the control is arranged to control the feeders such that in the at least one flap, an additional product is included.

21. The packaging line according to claim 20, wherein the control drives the packaging line such that a packaged product is obtained with a series of mutually connected flaps wherein in each, or at least in a number of the flaps, a product is included.

* * * * *